US007460822B2

(12) United States Patent
Potter et al.

(10) Patent No.: US 7,460,822 B2
(45) Date of Patent: Dec. 2, 2008

(54) PRINTING ROLL HAVING A CONTROLLABLE HEAT-ABSORBING INTERNAL SURFACE

(75) Inventors: Scott M. Potter, Welwyn Garden (GB); John Poxon, Stevenage (GB); Pieter Mulder, Welwyn Garden (GB)

(73) Assignee: Xerox Corporation, Norwalk, CT (US)

( * ) Notice: Subject to any disclaimer, the term of this patent is extended or adjusted under 35 U.S.C. 154(b) by 252 days.

(21) Appl. No.: 11/498,699

(22) Filed: Aug. 3, 2006

(65) Prior Publication Data

US 2008/0031662 A1 Feb. 7, 2008

(51) Int. Cl.
*G03G 15/20* (2006.01)

(52) U.S. Cl. ..... 399/330; 399/328; 399/333; 219/216; 430/124.32; 347/156; 492/18; 492/46

(58) Field of Classification Search ..... 399/330, 399/333, 328; 219/216; 430/124.3, 124.32; 347/156; 492/18, 46

See application file for complete search history.

(56) References Cited

U.S. PATENT DOCUMENTS 4,028,118 A 6/1977 Nakasuji et al.
4,421,560 A 12/1983 Kito et al.
5,153,411 A * 10/1992 Ndebi ..... 219/216
5,253,100 A 10/1993 Yang et al.
5,426,143 A 6/1995 de Wit et al.
5,708,525 A 1/1998 Sheridon
5,724,639 A * 3/1998 Tamura et al. ..... 399/333
5,974,294 A * 10/1999 Tange ..... 399/328

OTHER PUBLICATIONS

"Solar Energy Regulation through Electrochromic Windows based on Polyaniline, Prussian Blue and Tungsten Oxide," Bjorn Petter Jelle and Georg Hagen, Building Physics 2002—6th Nordic Symposium, Session 8: Energy Use 2, pp. 357-364.
Guinneton et al, "Optimized Infrared Switching Properties . . . " *Thin Solid Films* 446 (2004) 287-295.
Towns, "The heat is on for new colours," *JSDC*, vol. 115 Jul./Aug. 1999, 196-199.
http://www.azom.com/details.asp?ArticleID=1197
"Polyaniline—Processing and Applications".
Lu et al., "Use of Ionic Liquids for π—Conjugated Polymer Electrochemical Devices," *Science*, vol. 297, 983-987 (2002).

* cited by examiner

*Primary Examiner*—David M Gray
*Assistant Examiner*—G. M. Hyder
(74) *Attorney, Agent, or Firm*—R. Hutter

(57) ABSTRACT

A roll useful in fusing marking material to a print sheet includes a coating disposed on at least a portion of the inner surface thereof. A lamp disposed inside the roll supplies radiant energy to the inner surface. The coating changes its absorptivity (such as color) as desired, to obtain specific desired temperatures at different portions of the roll. The coating can be thermochromic, changing its absorptivity in response to local temperature; or electrochromic, changing its absorptivity in response to an external electrical stimulus.

12 Claims, 4 Drawing Sheets

PRINTING ROLL HAVING A CONTROLLABLE HEAT-ABSORBING INTERNAL SURFACE

TECHNICAL FIELD

An embodiment of the present disclosure relates to printing, such as xerographic printing or copying. More broadly, the disclosure relates to controlling the temperature of various portions of a tube or roll.

BACKGROUND

In electrostatographic printing, commonly known as xerographic printing or copying, an important process step is known as "fusing." In the fusing step of the xerographic process, dry marking material, such as toner, which has been placed in imagewise fashion on an imaging substrate, such as a sheet of paper, is subjected to heat and/or pressure in order to melt or otherwise fuse the toner permanently on the substrate. In this way, durable images are rendered on the substrates.

Currently, the most common design of a fusing apparatus as used in commercial printers includes two rolls, typically called a fuser roll and a pressure roll, forming a nip therebetween for the passage of the substrate therethrough. Typically, the fuser roll further includes, disposed on the interior thereof, one or more heating lamps, which radiate heat in response to a current being passed therethrough. The heat from the heating lamps passes through the surface of the fuser roll, which in turn contacts the side of the substrate having the image to be fused, so that a combination of heat and pressure successfully fuses the image.

In designing a fusing apparatus, there are a number of competing considerations. A thin-walled fuser roll is useful from the standpoint of rapid warm-up, but presents problems in distributing heat along the length thereof, such as causing "hot spots," especially in areas where the print sheet does not contact the fuser roll to remove or absorb heat. Even when a feedback system is provided for controlling the temperature of the lamps within the fuser roll, the hot spot problem can persist.

SUMMARY

According to one aspect, there is provided an apparatus useful in printing, comprising a roll defining an outer surface and an inner surface. A structure is provided for controlling absorptivity of at least a portion of the inner surface.

DETAILED DESCRIPTION

Figure 1:
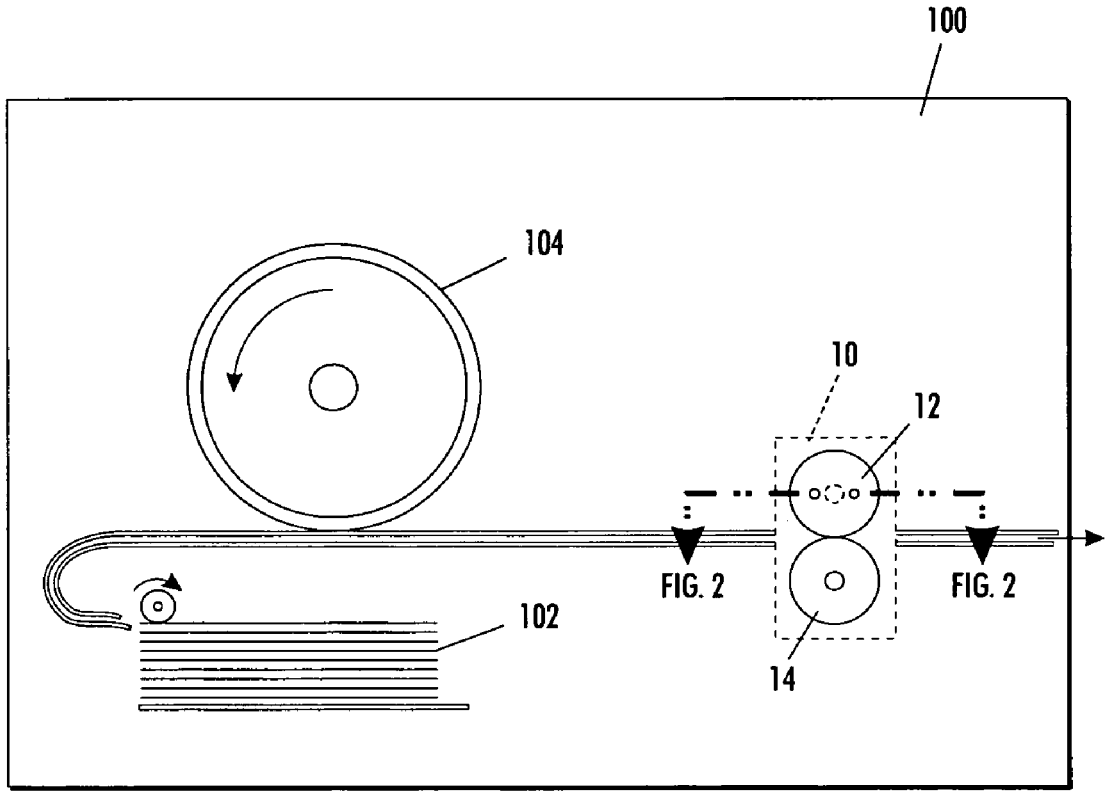
FIG. 1 PRIOR ART
FIG. 1 is a simplified elevational view showing the essential portions of an electrostatographic printer.

FIG. 1 is a simplified elevational view showing the essential portions of an electrostatographic printer, such as a xerographic printer or copier, relevant to the present invention. A printing apparatus 100, which can be in the form of a digital or analog copier, "laser printer," ionographic printer, or other device, includes mechanisms which draw substrates, such as sheets of paper, from a stack 102 and cause each sheet to obtain a toner image from the surface of a charge receptor 104, on which electrostatic latent images are created and developed through well-known processes. Once a particular sheet obtains marking material from charge receptor 104, the sheet (now a print sheet) is caused to pass through a fusing apparatus such as generally indicated as 10.

A typical design of a fusing apparatus 10 includes a fuser roll 12, in the form of a tube, and a pressure roll 14. Fuser roll 12 and pressure roll 14 cooperate to exert pressure against each other across a nip formed therebetween. When a sheet passes through the nip, the pressure of the fuser roll 12 against the pressure roll 14 contributes to the fusing of the image on a sheet. Fuser roll 12 further includes means for heating the surface of the roll, so that heat can be supplied to the sheet in addition to the pressure, further enhancing the fusing process. Typically, the fuser roll 12, having the heating means associated therewith, contacts the side of the sheet having the image desired to be fused.

Figure 2:
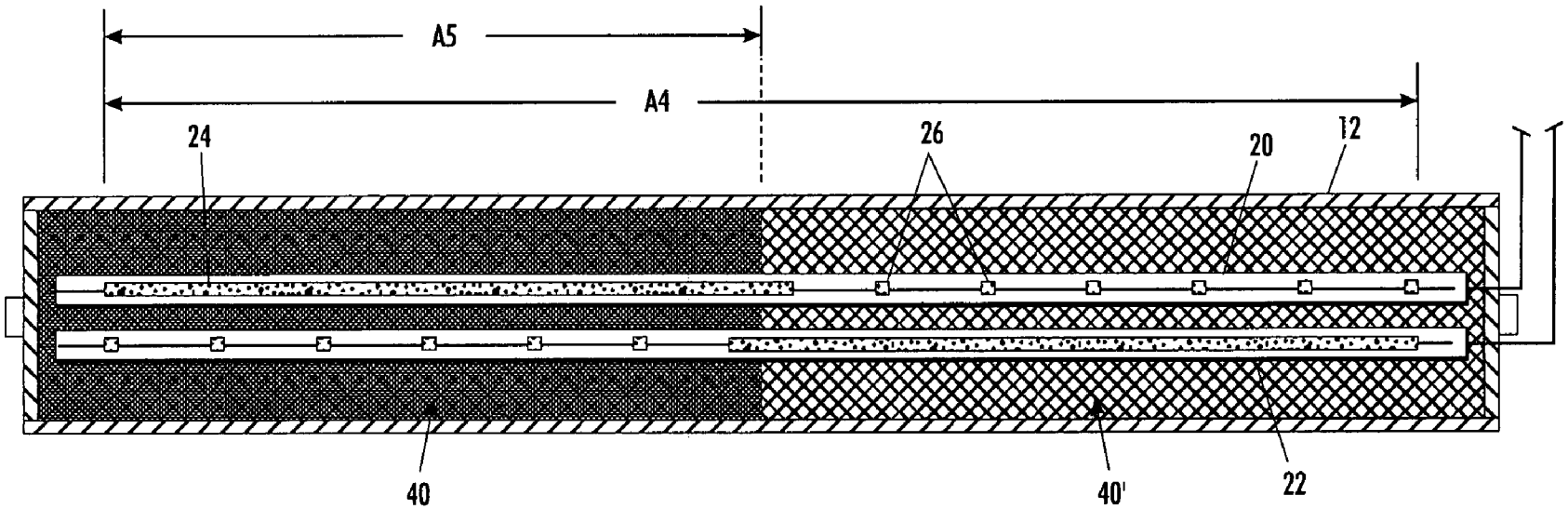
FIG. 2 is a sectional view of a fuser roll as viewed through the line marked 2-2 in FIG. 1.

In a common design, fuser roll 12 includes one or more heating lamps, so that heat generated by the heating lamps will cause the outer surface of fuser roll 12 to reach a desired temperature. FIG. 2 is a sectional view of the fuser roll 12 as viewed through the line marked 2-2 in FIG. 1. As can be seen in FIG. 2, there is disposed within the interior of fuser roll 12 two heating lamps, indicated as 20 and 22. The lamps 20 and 22 are each disposed along the axial length of the fuser roll 12, and as such are disposed to be largely perpendicular to a direction of passage of the sheets passing through the nip of the fusing apparatus 10. Each lamp emits radiant energy of a predetermined set of wavelengths, such as including infrared.

As can be seen in FIG. 2, each lamp, such as 20, includes a specific configuration of heat-producing material, in this particular case, a relatively long major portion of heat-producing material 24, along with a number of smaller portions of heat-producing material, indicated as 26, all of which are connected in series. It will be noted that, within each lamp such as 20 or 22, major portion 24 is disposed toward one particular end of the fuser roll 12, while the relatively smaller portions 26 are disposed toward the opposite end of the fuser roll 12. In a practical embodiment, the heat-producing material substantially comprises tungsten, while the overall structure of the lamp is borosilicate glass: these materials are fairly common in the fuser-lamp context. Other configurations of heat-producing material can be provided for a particular purpose.

Further shown in FIG. 2 is a representation of typical contact zones, here indicated as A4 and A5, such as to correspond to standard paper sizes, that show where sheets of each size would contact the roll surface when the printer is in use. The smaller A5 contact zone could be centered along the roll 12 or could be toward one end, depending on the overall architecture of the printer. Regardless of the size or position of the sheets being printed upon, there will usually be a significant portion of the length of the roll 12 that is not in contact with a sheet, usually over a significant period of run time. These unused portions of the roll typically are not able to dissipate heat at the same rate as the portions of the roll which come into contact with print sheets, because each passing print sheet absorbs and removes heat taken from the contact area. Accumulation of heat in the unused areas contributes to undesirable "hot spots."

The FIG. 2 embodiment proposes coating at least a portion of an inner surface of the fuser roll 12 with a thermochromic coating, that is, a coating that alters an optical property, such as reflectivity or absorptivity, in response to a change in temperature. In one possible arrangement, the coating 40 becomes more reflective, and therefore less absorptive, of radiant energy from lamps 20, 22 as its temperature increases. Because it becomes less absorptive, the coating resists further heating from the lamps 20, 22: in effect the interaction between increasing temperature and absorptivity yields a self-controlling system that will limit around a desired temperature.

An advantage of using a thermochromic coating to enable a self-controlling system is that the coating 40 can compensate for local temperature anomalies anywhere on the surface of the roll 12. For instance, if the areas along the roll 12 that are not part of a contact area become unusually hot, the heat in the localized area will cause the coating 40 associated therewith to become more reflective, and thus resistant to further heating by the lamps 20, 22; simultaneously, however, the areas within the contact areas, having heat removed therefrom by passing sheets, will be relatively more absorptive of radiant energy from the lamps 20, 22, enabling those areas to compensate and maintain a temperature that is consistent both within the contact area and relative to outside the contact area.

The coating 40 can also be used to prevent or counteract consistent small hot spots that may be caused, for instance, by defects in the structure of the fuser roll 20. Also, the coating 40 is useful for equalizing temperature around a circumference of fuser roll 20: within a contact area, there is likely to be a sudden decrease in temperature immediately downstream of the fuser nip. The decrease in temperature causes the local coating 40 to become more absorptive of energy from lamps 20, 22, and thus return quickly to a useful temperature before the area rotates to the nip again.

A useful thermochromic candidate material would be able to withstand temperatures well above 200 Deg C. and have a switching temperature around 200 Deg C., switching from absorbent (<200 Deg C.) to reflective (>200 Deg C.). Guinneton et al, "Optimized Infrared Switching Properties . . . " *Thin Solid Films* 446 (2004) 287-295, describe vanadium dioxide films which are absorbent at lower temperatures and reflective at higher temperatures, although such films generally switch at too low a temperature (68 Deg C.) for most common fusing applications. Towns, "The heat is on for new colours," *JSDC*, Volume 115 July/August 1999, 196-199, also mentions that liquid crystals can switch in a range up to 200 Deg C. U.S. Pat. Nos. 4,028,118 and 4,421,560 describe thermochromic materials in general. U.S. Pat. No. 5,426,143 describes thermochromic infrared dyes that switch, depending on the exact dye, in a range from 100-190 Deg C.

Although a basic embodiment would provide for a uniform coating of the thermochromic material throughout the inner surface of roll 12, certain configurations of such a coating can be useful. In one case, the coating may be disposed only in sections corresponding to contact areas such as A4 or A5, or exclusive of those areas, as required to obtain the desired temperature distribution along the roll 12 in various situations. Alternatively, the coating could be provided in a partial coating creating a density of the thermochromic material, such as in a regular dot or banded (parallel or perpendicular to the axis) pattern. The partial coating could be provided with some relation to the intended contact areas, such as in the contact area included in A4 but not A5, or in any other configuration. In another embodiment, a section of the inner surface, such as corresponding to the A5 section, is coated with a pattern having a first density (such as 50% coverage of the inner surface) while another section, shown in FIG. 2 as 40', corresponding to the balance of the inner surface, is coated with a pattern having a second density (such as 75% coverage of the inner surface). Different arrangements of densities could be adapted for different applications, in the printing context or other contexts. It is further possible to provide different color coatings, each with a different absorptivity, on the inner surface of the roll.

In one embodiment, the coating 40 is placed on the interior surface of a roll 12 substantially comprising aluminum. Such a structure maintains the practical advantages of an all-aluminum roll, such as rapid warm-up.

Another approach to controlling the temperature of the outer surface of a roll or tube is to provide, associated with at least a portion of the inner surface of a roll or tube, a structure or material that alters its absorptivity to radiant energy in response to an electrical stimulus of some kind.

Figure 3:
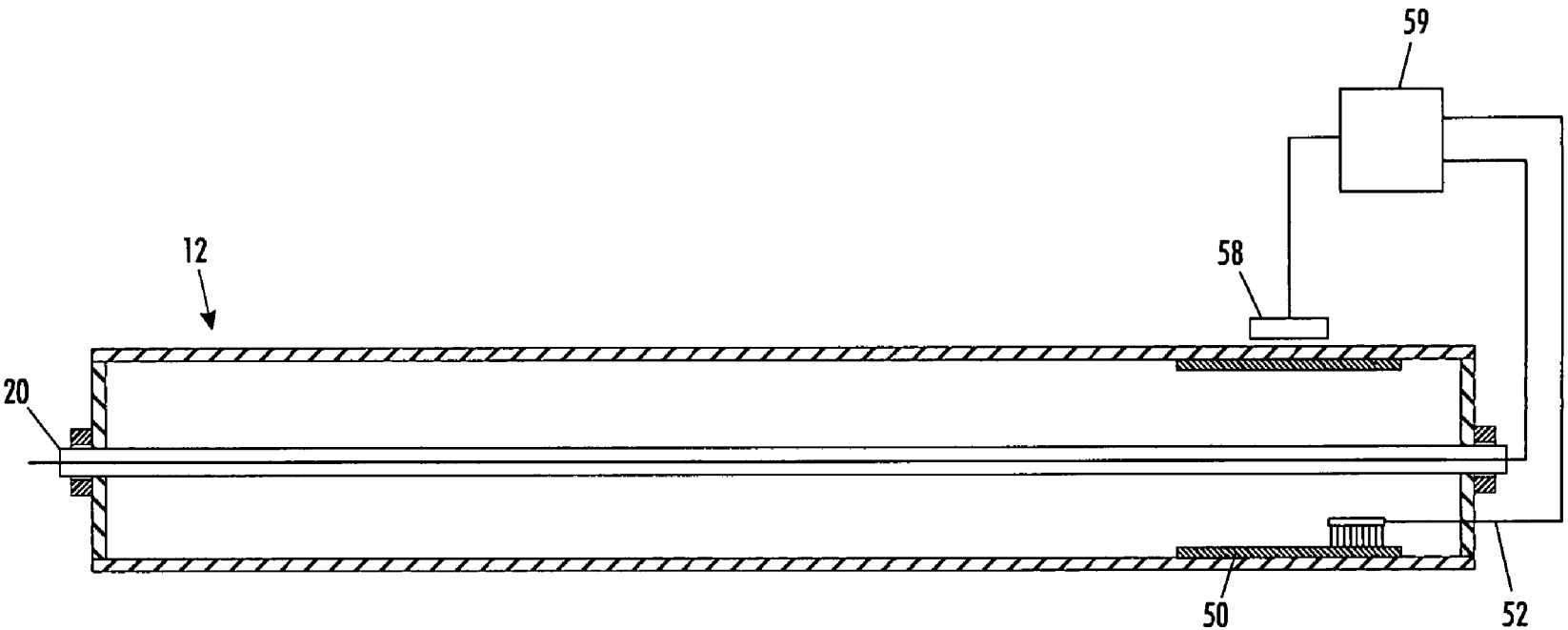
FIG. 3 is simplified sectional view of a roll employing an electrochromic structure.

FIG. 3 is simplified sectional view of a roll employing an electrochromic structure, i.e., a structure and/or material that alters its absorptivity in response to an electrical stimulus of some kind. In this embodiment, it can be seen that a section 50 of the inner surface of a roll 12 is provided with a coating that changes its absorptivity in response to an electrical charge, such as supplied by brush 52 (or equivalent brush-like contact), which provides charge as needed from an external power supply (not shown). When it is desired to have section 50 be more absorptive of radiant energy from a lamp such as 20, a charge of some type is supplied via brush 52 to the coating on section 50, causing the electrochromic material to be more absorptive. Different types (such as magnitude and polarity) of signals and charges can be supplied to section 50 depending on the specific structures and materials used for a given situation.

Any number of further approaches can be taken to control, through electrical stimulus, the absorptivity of selected sections of the inner surface of a roll 12. One approach includes providing liquid crystal diodes (LCD's) of LCD-like structures on the inner surface of roll 12, such an LCD structure being capable of turning as needed from substantially white or reflective gray to substantially black. Such an LCD structure may include electric leads (not shown) disposed within the wall of roll 12, such leads connecting the LCD structures to external voltage sources, either through a brush-like structure as shown in FIG. 4 or through, for instance, the axle-ends (not shown) of a rotatable roll.

Another approach can include "bistable" display technology, such as those known as Gyricon® or E-Ink®, disposed on the inner surface of a roll 12. U.S. Pat. No. 5,708,525, for instance, shows a general overview of Gyricon technology. In a bistable display, an electrical signal is applied to an area on the display only to change the status of the display (generally speaking, from black to white, or vice-versa). After the signal that changes the status of the area on the display, the status (black or white) generally remains stable until a subsequent electrical signal is applied. With Gyricon technology, the status of a given area can be changed largely by applying a small charge of a predetermined polarity to an area of the display, such as with a conductive soft brush. E-Ink technology can be similarly adapted for use in this application.

Further as shown in FIG. 3, the brush 52 influencing the absorptivity of portion 50 can be operated by a feedback loop for maintaining a desired temperature of the outer surface of roll 12, such as including a thermistor 58 and control system 59. Control system 59 can be operative of either brush 52 or of the whole lamp 20, or both.

Figure 4:
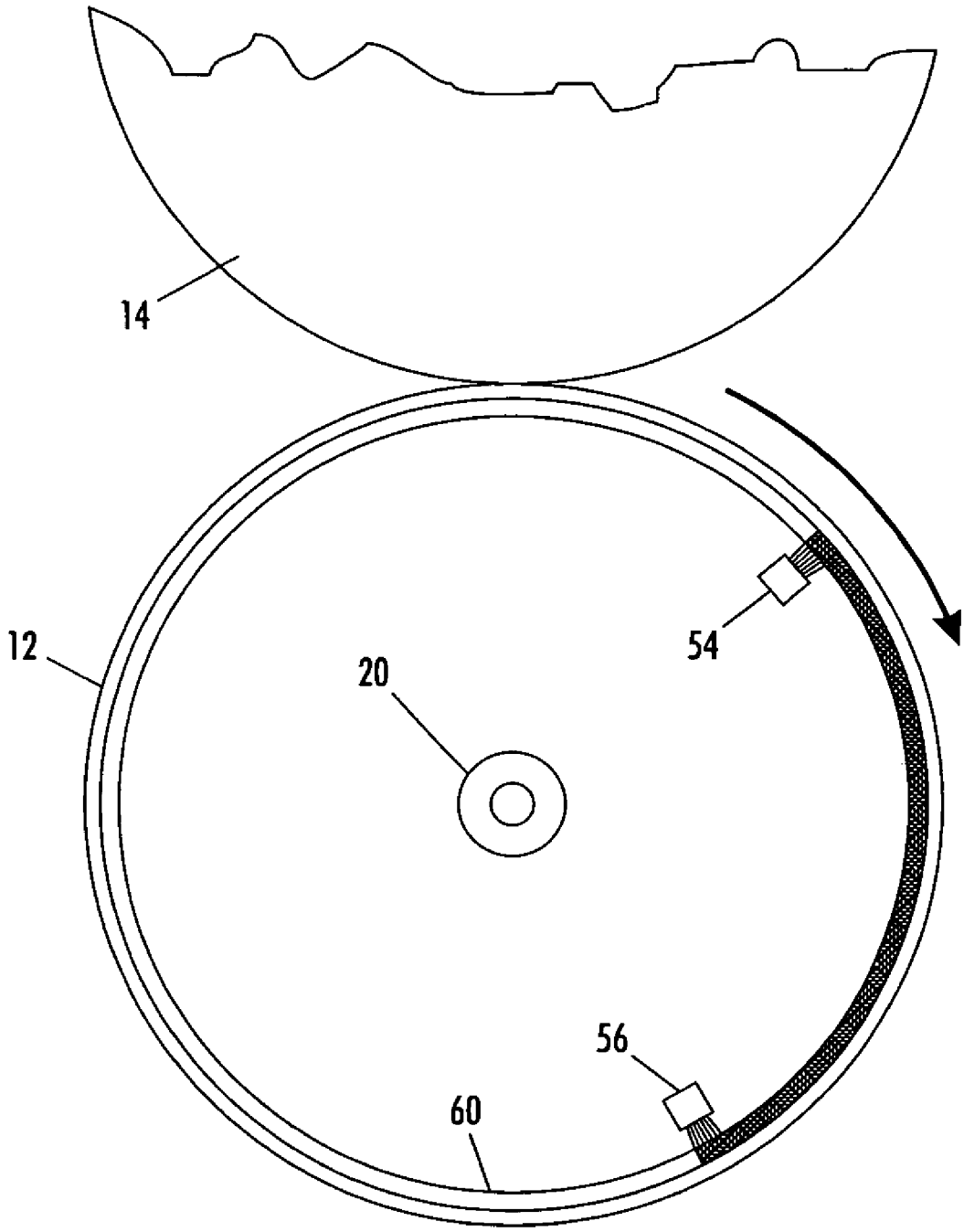
FIG. 4 is a sectional view through a circumference of a roll in contact with another roll.

FIG. 4 is a sectional view through a circumference of a roll 12 (in contact with another roll 14), showing how electrochromic structure and/or materials can be used to control the absorptivity or radiant energy in different portions of a circumference of a roll, particularly a rotating roll. As shown, a first brush 54, which can extend the length of a section of interest of the roll 12 (in the view of FIG. 4, into the page), is disposed at a first location along the circumference, and a second brush 56 is disposed at a second location along the circumference. With certain types of technology, such as, for example, a Gyricon or other bistable display such as 60, the first brush 54 applies a charge of a polarity to make the display 60 largely black for the zone downstream of the brush 54 along the circumference, while the second brush 56 applies the opposite charge to turn the display largely white as the small areas of the display move past the brush 56.

In this way, the inner surface of roll 12 is relatively highly absorptive of radiant energy in the (moving) portion of its circumference in the area between brushes 54 and 56. Such an arrangement may be useful, for instance, in situations where a portion of the circumference is desired to be heated fairly quickly. In a printing context, immediately downstream of a nip (such as between rolls 12 and 14) through which a print sheet passes, a great deal of heat is "taken away" from the system by the moving sheet at the nip. It would therefore be desirable to make the zone of the circumference just past the nip particularly absorptive of radiant energy from the lamp 22. Other situations may call for placements of high- or low-absorptive areas just upstream of the nip, around the nip, or elsewhere along the circumference of a roll 12.

Jelle, et al., "Solar Energy Regulation through Electrochromic Windows based on Polyaniline, Prussian Blue and Tungsten Oxide," *Building Physics* 2002-6$^{th}$ *Nordic Symposium,* 357-364; U.S. Pat. No. 5,253,100; an article at http://www.azom.com/details.asp?ArticleID=1197 (printed copy submitted herewith); and Lu et al., "Use of Ionic Liquids for π-Conjugated Polymer Electrochemical Devices," *Science,* Vol. 297, 983-987 (2002) all provide teachings useful in realizing a practical version of an electrochromatically-controlled device.

Although the illustrated and described embodiments relate to application in a fuser roll as used in a xerographic printing apparatus, the teachings can readily be applied to applications in other printing technologies as needed, such as offset or ink-jet, as well as situations where printing media is preheated or otherwise treated prior to printing thereon. Although the illustrated and described embodiments relate to a rigid roll, the term "roll" can be construed broadly to include flexible belts. Also, although the absorptivity-controllable portions of a "roll" are here described as an "inner surface" of the roll, the term "inner surface" can apply to any surface of a "roll" adjacent to a source of radiant energy; that is, the source of radiant energy could be disposed outside the roll.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An apparatus useful in printing, comprising
a roll defining an outer surface and an inner surface;
a structure for controlling absorptivity of at least a portion of the inner surface, the structure including a material that changes absorptivity in response to electrical stimulus.

2. The apparatus of claim 1, further comprising
a source of radiant energy disposed inside the roll.

3. The apparatus of claim 1, the structure including an LCD.

4. The apparatus of claim 1, the structure including bistable display technology.

5. The apparatus of claim 1, further comprising
a source of electrical stimulus disposed relative to a section of the roll, the source being capable of selectively altering the absorptivity of the section.

6. The apparatus of claim 5, the source of electrical stimulus being operable on the inner surface of the roll when the roll is rotating.

7. The apparatus of claim 5, further comprising
a source of electrical stimulus disposed relative to a portion of a circumference of the roll.

8. The apparatus of claim 5, the source of electrical stimulus being operable on the inner surface of the roll when the roll is rotating.

9. The apparatus of claim 5, further comprising
a second source of electrical stimulus disposed relative to a second portion of a circumference of the roll, the source and the second source being capable of selectively altering the absorptivity of the portion of the circumference between the source and the second source.

10. The apparatus of claim 5, further comprising
a thermistor associated with at least a portion of the roll.

11. The apparatus of claim 10, further comprising
a feedback loop associated with the thermistor, the feedback loop being at least partially operative of the source of electrical stimulus.

12. The apparatus of claim 11, further comprising
a source of radiant energy disposed inside the roll; and
a feedback loop associated with the thermistor, the feedback loop being at least partially operative of the source of radiant energy.

* * * * *